United States Patent [19]

Baur

[11] 4,326,974

[45] Apr. 27, 1982

[54] OIL-IN-WATER EMULSION FOR COLD ROLLING LIGHT METALS

[75] Inventor: Rudolf Baur, Kreuzlingen, Switzerland

[73] Assignee: Swiss Aluminium Ltd., Chippis, Switzerland

[21] Appl. No.: 213,849

[22] Filed: Dec. 8, 1980

[30] Foreign Application Priority Data

Sep. 12, 1980 [CH] Switzerland ..... 6863/80

[51] Int. Cl.[3] ..... C10M 1/06

[52] U.S. Cl. ..... 252/49.5

[58] Field of Search ..... 252/49.5

[56] References Cited

U.S. PATENT DOCUMENTS

| | | | |
|---|---|---|---|
| 2,981,128 | 4/1961 | Flemming | 252/49.5 X |
| 3,649,538 | 3/1972 | Hotten | 252/49.5 X |
| 3,770,636 | 11/1973 | McDole et al. | 252/49.5 |
| 3,798,164 | 3/1974 | Kmet et al. | 252/49.5 X |
| 3,835,052 | 9/1974 | McDole et al. | 252/49.5 X |
| 3,855,136 | 12/1974 | McDole et al. | 252/49.5 |
| 3,923,671 | 12/1975 | Knepp | 252/49.5 |
| 4,062,784 | 12/1977 | Baur | 252/49.5 |
| 4,075,393 | 2/1978 | Sturwold | 252/49.5 |

*Primary Examiner*—Andrew Metz

*Attorney, Agent, or Firm*—Bachman and LaPointe

[57] ABSTRACT

The oil-in-water emulsion contains, besides the usual components, xylitol and sorbitol to inhibit water staining. The inhibitor is fully effective even when 1000 parts by weight of the emulsion contain only 1–30 parts by weight each of xylitol and sorbitol.

By making this addition of inhibitor the reaction of the water phase with the metal surface freshly created by rolling is to a large degree eliminated and with that also the elimination of the formation of undesirable water stains on the surface of the strip.

6 Claims, No Drawings

OIL-IN-WATER EMULSION FOR COLD ROLLING LIGHT METALS

BACKGROUND OF THE INVENTION

The invention relates to an oil-in-water emulsion for cold rolling light metals, in particular aluminum and aluminum alloys, containing for example polyisobutylene as hydrodynamic film former, alkylmonocarboxylic acid esters as reaction layer former, polyethoxylated sorbitanoleates as emulsifier, unsaturated, long chain alkylmonocarboxylic acids as inhibitor against hydrogen embrittlement and rusting, hexamethylenetetramine as stabilizer, fungicide and bactericide and deionized water.

Compared with oil-based rolling lubricants oil-in-water emulsions, because of the larger heat of vaporization of water, permit much better cooling and consequently a much larger reduction per pass and/or higher rolling speed. Besides these purely economic factors which help achieve greater efficiency, it must also be mentioned that aqueous folling lubricants produce much less severe problems due to waste fumes and are less dependent on mineral oil. For this reason many trials have already been carried out in the light metal industry, in particular in the aluminum industry, with a view to using oil-in-water emulsions for cold rolling strip.

Revealed in the German Auslegeschrift No. 26 32 142 is an oil-in-water emulsion for cold rolling light metals, containing alkylmono carboxylic acid esters as reaction layer former, polyisobutylene as hydrodynamic film former, polyethoxylated sorbitanoleates as emulsifier, unsaturated, long chain alkylmonocarboxylic acid as inhibitor against hydrogen embrittlement and rusting, hexamethylenetetramine as stabilizer, fungicide and bactericide, balance deionized water.

A basic disadvantage with the oil-in-water emulsions representing the state of the art is that the freshly formed surface produced by rolling reactants with water within the space of only a few seconds. This corrosive attack of the surface by the aqueous phase leads to undesirable stains on the surface of the strip. The poorer surface quality of the strip or foil due to these water stains is unacceptable for many applications. With the known oil-in-water emulsions it is therefore absolutely essential that the emulsion is removed as completely as possible, immediately after the strip exits from the rolls, for example by blowing with compressed air.

SUMMARY OF THE INVENTION

In view of these facts it is an object of the invention to develop an oil-in-water emulsion of the kind mentioned at the start for cold rolling light metals, in particular aluminum and aluminum alloys, by means of which the tendency to form water stains on the surface of freshly rolled strip can be reduced.

This object is achieved by way of the invention in that the emulsion contains additionally xylitol and sorbitol to inhibit water staining.

DETAILED DESCRIPTION

By adding xylitol and sorbitol together to an oil-in-water emulsion the tendency to form water stains is to a large degree eliminated. It is, therefore, no longer absolutely necessary to remove the emulsion from the surface of the freshly rolled strip. The inhibitor is fully effective even when 1000 parts by weight of emulsion contain only 1–30 parts by weight each of xylitol and sorbitol.

It has furthermore also been found that the effect of adding xylitol and sorbitol together as inhibitor can be improved even further by adding glycerine. Usefully 1000 parts by weight of emulsion contain 20–90 parts by weight of glycerine.

The addition of xylitol and sorbitol and, if desired, glycerine does not affect rolling and also if the rolled strip is subsequently annealed does not lead to residues on the surface of the strip.

The advantages of the addition of the water-stain inhibitor according to the invention are made clear in the results from trials carried out with the following cold rolling emulsions.

| | |
|---|---|
| Emulsion 1 | |
| Butyllaurate: | 25 parts by weight |
| Polyisobutylene, average molecular weight 460: | 27 parts by weight |
| Polyisobutylene, average molecular weight 320: | 18 parts by weight |
| Sorbitol-polyoxyethylene-hexaoleates: | 10 parts by weight |
| Oleic acid: | 10 parts by weight |
| Hexamethylenetetramine: | 10 parts by weight |
| Xylitol: | 10 parts by weight |
| Sorbitol: | 10 parts by weight |
| Deionized water: | 880 parts by weight |
| Emulsion 2 | |
| Palm kernel oil: | 30 parts by weight |
| Sorbitol-polyoxyethylene-hexaoleate: | 10 parts by weight |
| Oleic acid: | 10 parts by weight |
| Hexamethylenetetramine: | 10 parts by weight |
| Xylitol: | 10 parts by weight |
| Sorbitol: | 7 parts by weight |
| Gylcerine: | 45 parts by weight |
| Deionized water: | 878 parts by weight |
| Emulsion 3 | |
| Polyisobutylene, average molecular weight 460: | 10 parts by weight |
| Paraffin oil: | 20 parts by weight |
| Palm kernel oil: | 30 parts by weight |
| Sorbitol-polyoxyethylene-hexaoleate: | 10 parts by weight |
| Oleic acid: | 10 parts by weight |
| Hexamethylenetetramine: | 10 parts by weight |
| Xylitol: | 10 parts by weight |
| Sorbitol: | 7 parts by weight |
| Glycerine: | 45 parts by weight |
| Deionized water: | 848 parts by weight |

The organic components were mixed at room temperature by simple stirring and then deionized water added. Both, separate phases were then worked up to an emulsion in an emulsifying machine.

Cold rolling trials were then carried out on a single quarto rolling mill with aluminum of purity 99.2% using the above mentioned emulsions. The reductions per single pass were up to 92%. In no case could signs of water stains be detected on the rolled strips. Likewise, after subsequent annealing of the rolled strips none of the emulsions gave rise to residues on the strip surface.

What is claimed is:

1. In an oil-in-water emulsion for cold rolling light metals, in particular aluminum or aluminum alloys, the improvement which comprises adding a small but effective stain inhibiting amount of xylitol and sorbitol to the emulsion.

2. Emulsion according to claim 1 wherein 1000 parts by weight of emulsion contain 1–30 parts by weight each of xylitol and sorbitol.

3. Emulsion according to claim 2 wherein 1000 parts by weight of emulsion contain additionally 20–90 parts by weight of glycerine.

4. In an oil-in-water emulsion for cold rolling light metals, in particular aluminum and aluminum alloys, said emulsion comprising an aqueous oil-in-water emulsion rolling lubricant containing polyisobutylene as hydrodynamic film former, alkylmonocarboxylic acid esters as reaction layer former, polyethoxylated sorbitanoleates as emulsifier, unsaturated, long chain alkylmonocarboxylic acids as inhibitor to prevent hydrogen embrittlement and rusting, fungicide and bactericide, and the balance essentially deionized water, the improvement which comprises adding a small but effective stain inhibiting amount of xylitol and sorbitol to the emulsion.

5. Emulsion according to claim 4 wherein 1000 parts by weight of emulsion contain 1–30 parts by weight each of xylitol and sorbitol.

6. Emulsion according to claim 5 wherein 1000 parts by weight of emulsion contain additionally 20–90 parts by weight of glycerine.

* * * * *